United States Patent [19]

Yamashita et al.

[11] Patent Number: 4,746,603

[45] Date of Patent: May 24, 1988

[54] NEGATIVE TYPE SILVER HALIDE PHOTOGRAPHIC EMULSIONS

[75] Inventors: Seiji Yamashita; Naoto Ohshima; Shunji Takada, all of Kanagawa, Japan

[73] Assignee: Fuji Photo Film Co., Ltd., Kanagawa, Japan

[21] Appl. No.: 882,010

[22] Filed: Jul. 3, 1986

[30] Foreign Application Priority Data

Jul. 4, 1985 [JP] Japan ..... 60-147121

[51] Int. Cl.[4] ..... G03C 1/08

[52] U.S. Cl. ..... 430/603; 430/605; 430/569

[58] Field of Search ..... 430/569, 603, 604, 605

[56] References Cited

U.S. PATENT DOCUMENTS 2,448,060 8/1948 Smith et al. ..... 430/605
4,288,535 9/1981 Kanisawa et al. ..... 430/605
4,469,783 9/1984 Kuwabara et al. ..... 430/605
4,477,561 10/1984 Menjo et al. ..... 430/605
4,617,258 10/1986 Menjo et al. ..... 430/605
4,621,041 11/1986 Saikawa et al. ..... 430/569

*Primary Examiner*—Won H. Louie
*Attorney, Agent, or Firm*—Sughrue, Mion, Zinn, Macpeak & Seas

[57] ABSTRACT

Negative type silver halide photographic emulsions are provided, formed by growing silver halide grains in the presence of a water-soluble iridium salt in a molar ratio of $3\times10^{-4}$ mol or more to the amount of the total silver halides used in the formation of the silver halide grains and then chemically sensitizing the surfaces of the grains formed with a sulfur compound or with a sulfur compound and a gold compound. The present emulsions have high sensitivity and extremely improved variation of sensitivity and gradation under broad exposure conditions of high intensity exposure and low intensity exposure.

8 Claims, No Drawings

NEGATIVE TYPE SILVER HALIDE PHOTOGRAPHIC EMULSIONS

FIELD OF THE INVENTION

The present invention relates to light-sensitive negative type silver halide emulsions and, more precisely, to those of high sensitivity which have extremely improved variation of sensitivity and gradation under high intensity exposure and low intensity exposure.

BACKGROUND OF THE INVENTION

Recently, negative films of higher sensitivity and broader exposure aptitude have been required with the variation of color negative films into small format styles under various photographic conditions.

Under such circumstances, various proposals have been made for the purpose of improving the photographic properties by the addition of iridium to the silver halide emulsions thereof, including one typical embodiment where silver halide grains are formed in the presence of $10^{-8}$ to $10^{-5}$ mol of iridium per 1 mol of silver, which is to be added to the emulsion at a certain stage of the formation thereof, resulting in various effects of intensification of sensitization, improvement of high intensity reciprocity low failure and improvement of fogging inhibition. These techniques are described in, for example, Japanese Patent Publication Nos. 4935/68 and 32738/70 or Japanese Patent Application (OPI) Nos. 221839/83 and 152438/84 (the term "OPI" as used herein refers to a "published unexamined Japanese patent application"). In these publications, however, it is reported that the amount of the iridium to be added is preferably $10^{-7}$ to $10^{-6}$ mol/mol AgX and that any sufficient effect cannot be attained when $10^{-8}$ mol or less iridium is added, and further it is additionally reported in the publications that the addition of $10^{-5}$ mol or more iridium results in a noticeable reduction of the sensitivity with no improvement of the characteristics of the emulsions and, therefore, is no more practicable. However, this conclusion almost is based upon the results of examples where at most $10^{-4}$ mol or less iridium is used.

In such background, examples for the preparation of silver halide fine grains containing iridium of high concentration, as found in the present invention, are almost merely those for the measurement of the physical properties of the grains (for example, refer to *Journal of Japan Photographic Society,* Vol. 31, No. 3, page 139 (1968)), and there are few examples for the evaluation of photographic characteristics of the photographic materials. In fact, there is only one example, where $3\times10^{-4}$ mol/mol AgX of iridium is added to silver halide grains which are not chemically sensitized. (Refer to *Photographic Science and Engineering,* Vol. 19, No. 4, page 214 (1975)).

On the other hand, some examples are noted where a large amount of iridium is added to direct positive type silver halide emulsions, as so defined in the present invention. (For instance, refer to Japanese Patent Publication Nos. 37530/75 and 186739/83.) However, the direct positive type silver halide emulsions are those for the formation of positive images by the use of such mechanisms as bleaching the fogged nuclei in the previously fogged surface, and, therefore, are fundamentally different from the other negative type emulsions for the formation of latent images on the surfaces of grains when exposed to light.

SUMMARY OF THE INVENTION

The essential object of the present invention is to provide negative type silver halide emulsions of high sensitivity, which are highly sensitive under broad exposure conditions.

The present inventors have earnestly investigated various problems in order to attain the object and have found that the object is attained by growing silver halide grains in the presence of a water-soluble iridium salt in an amount of $3\times10^{-4}$ mol or more per 1 mol of the silver halides in the formation of the silver halide grains followed by chemical sensitization of the resulting silver halide emulsion with a sulfur compound or with a sulfur compound and a gold compound.

DETAILED DESCRIPTION OF THE INVENTION

The water-soluble iridium salts which are used in the present invention are not specifically limitative, and, for example, include the following compounds:

$K_3IrCl_6$, $K_2IrCl_6$, $(NH_4)_2IrCl_6$, $NA_2IrCl_6$, $IrCl_4$, $IrBr_4$, $IrBr_3.4H_2O$

Among these compounds, $K_3IrCl_6$, $K_2IrCl_6$, $(NH_4)_2IrCl_6$ and $Na_2IrCl_6$ are preferably used in the present invention.

In the present invention, any combinations of trivalent compounds and tetravalent compounds among these compounds may be used.

These iridium compounds are used dissolved in water or in a pertinent solvent, and some conventional means for the stabilization of the iridium compound-containing solutions may be adapted thereto, including the addition of a hydrogen halide aqueous solution (such as HCl, HBr or HF aqueous solution) or an alkali halide (such as KCl, NaCl, KBr or NaBr) to the iridium compound-containing solution.

The amount of the water-soluble iridium compound to be used in the preparation of silver halide emulsions in the present invention is $3\times10^{-4}$ mol or more per 1 mol of the finally formed total silver halides, and is preferably $5\times10^{-4}$ to $3\times10^{-3}$ mol. The use of the water-soluble iridium salt within the range of $1\times10^{-5}$ to $3\times10^{-4}$ mol per 1 mol of the silver halides is not desirable, as it causes extreme reduction of sensitivity or solarization, even though the conditions in the chemical sensitization are properly regulated. On the other hand, if the amount of the iridium salt to be used is larger than $5\times10^{-3}$ mol, the salt will cause cross-linking of the gelatin already existing in the emulsion when the salt is added, and, therefore, the formed emulsions are no longer usable as photographic emulsions. In such a case, some care should be taken with respect to the concentration of the gelatin to be used.

Regarding the means for the addition of the iridium salts, the total amount of the necessary salts may be added all at once at any desired stage during the formation of silver halide grains. Further, the salts may be added at intervals in several separate amounts or the salts may be gradually added continuously.

In the addition of the iridium salts, it is more preferred that 80% or more of the total amount to be added is added after the silver halide grains have grown to 70% or more of the average grain size thereof. For the continuous addition of the salts, for example, the iridium salt may be added to a silver halide aqueous solution when the halide grains are grown by means of a double jet method.

The silver halide grains which may be used in the present invention may be either polydispersed or monodispersed ones, and are preferably monodispersed grains.

The "monodispersed grains" means that 95% or more of the total grains fall within the range of an average grain size ±40%.

Regarding the structure of the grains, these may be any one of cubic, octahedral, tetradecahedral, tabular or potato-like shaped ones, and are preferably cubic grains. The halogen compositions of the grains may be any one of AgI, AgBr, AgCl or mixed crystals thereof such as AgBrI or AgBrCl, and are preferably AgBr or AgBrI. The grain size is 3.0 μm or less, preferably 1.0 μm or less, more preferably 0.5 μm or less, as based upon the diameter of the corresponding spheres.

The formation of the silver halide grains in the present invention is not specifically limitative, and the grains may be formed, in general, by mixing a solution of a water-soluble silver salt (such as silver nitrate) and a solution of a water-soluble halide (such as potassium bromide) in the presence of a water-soluble high molecular compound solution such as a gelatin solution.

For instance, these grains may be formed by means of known methods as described in *The Theory of the Photographic Process,* 4th Ed. (written by Mees and published by Macmillan, 1976); *Chimie Photographique* (written by P. Glafkides and published by Paul Montel, 1957); *Photographic Emulsion Chemistry* (written by C. F. Duffin and published by The Focal Press, 1966); and *Making and Coating Photographic Emulsion* (written by V. L. Zelikman, et al., and published by The Focal Press, 1960). As described in the literature, the present silver halide grains may be formed by any of an acidic method, a neutral method or an ammonia method; and for the reaction of the soluble silver salt and the soluble halide, any of single jet method, double jet method or combination thereof may be used.

A method for the formation of the grains in the presence of an excess silver ion (or a so-called reverse mixing method) may also be used. In addition, a so-called controlled double jet method, which is one embodiment of the double jet method, may also be used, where the pAg value in the liquid phase in which silver halide grains are formed is kept constant.

By the aforesaid method may be obtained silver halide emulsions containing grains of regular crystalline form and uniform grain size.

Regarding the addition rate of the water-soluble silver salt and the water-soluble halide, the addition rate may be accelerated with the lapse of time, as described in U.S. Pat. No. 3,650,757, or the concentration of the salts to be added may be elevated with the lapse of time, as described in U.S. Pat. No. 4,242,445, and the latter may be preferably used in the present invention.

In addition, seed crystals may previously be present in the reaction container, and the water-soluble silver salt and the water-soluble halide may be added thereto later, as described in British Pat. No. 1,469,480.

Silver halide solvents are preferably used in the formation of the silver halide grains.

Ammonia and thioether compounds are preferably used as the silver halide solvent, as described in U.S. Pat. Nos. 3,574,628 and 3,790,387.

The soluble salts are generally removed from the emulsion formed after the formation of precipitates or after the physical ripening thereof; and for this removal, a conventional and well known noodle washing method comprising gelling the gelatin may be used, or otherwise, a flocculation method may be used where a polyvalent anion-containing inorganic salt such as sodium sulfate, anionic surfactant, anionic polymer (e.g., polystyrenesulfonic acid) or a gelatin derivative such as aliphatic acylated gelatin, aromatic acylated gelatin or aromatic carbamoylated gelatin is used.

For the chemical sensitization of the silver halide grains in the present invention, a sulfur sensitization or a sulfur sensitization and a gold sensitization may be carried out, and the combination of the sulfur and gold sensitization is preferred.

In the addition of gold and sulfur compounds for the sensitization, the preferred amounts to be added are $10^{-7}$ to $10^{-4}$ mol and $10^{-7}$ to $10^{-3}$ mol, respectively, per 1 mol of the existing silver halide. The temperature in the chemical sensitization is preferably a lower temperature than that in the formation of the silver halide grains.

In the present invention, some other sensitization such as selenium sensitization or reduction sensitization may be carried out along with the sulfur sensitization and gold sensitization.

Active gelatins and sulfur-containing compounds capable of reacting with silver may be used as the sulfur sensitizer, including, for example, thiosulfates, thioureas, mercapto compounds and rhodanines.

Chloroaurates may be used as the gold sensitizer.

Stannous salts, amines and hydrazine derivatives may be used as the reduction sensitizer.

Regarding the chemical sensitization, the disclosure of *Research Disclosure,* Vol. 176, page 23 (December 1978) may be referred to.

The photographic emulsions to be used in the present invention may contain various compounds for the purpose of prevention of fog in the preparation or preservation of the light-sensitive materials or in the photographic treatment thereof or for the purpose of stabilization of the photographic characteristics of the materials. For instance, various kinds of compounds which are known as an antifogging agent or a stabilizer may be added to the present photographic emulsions for these purposes, including azoles (such as benzothiazolium salts, nitroimidazoles, nitrobenzimidazoles, chlorobenzimidazoles, bromobenzimidazoles, nitroindazoles, benzotriazoles, aminotriazoles); mercapto compounds (such as mercaptothiazoles, mercaptobenzothiazoles, mercaptobenzimidazoles, mercaptothiadiazoles, mercaptotetrazoles especially 1-phenyl-5-mercaptotetrazole, mercaptopyrimidines, mercaptotriazines); thioketo compounds such as oxazolinethione; azaindenes (such as triazaindenes, tetraazaindenes especially 4-hydroxy-substituted(1,3,3a,7)tetraazaindenes, pentaazaindenes); and benzenethiosulfonic acids, benzenesulfinic acids and benzenesulfonic acid amides.

Further detailed examples of these compounds and the use thereof are described in, for example, U.S. Pat. Nos. 3,954,474 and 3,982,947 and Japanese Patent Publication No. 28660/77, and the related disclosures may be referred to.

Gelatin is advantageously used as a binder or a protective colloid in the emulsions of the present invention, and in addition, any other hydrophilic colloids may also be used therefor.

For instance, proteins such as gelatin derivatives, graft polymers of gelatin and other high molecular substances, albumin and casein; cellulose derivatives such as hydroxyethyl cellulose, carboxymethyl cellulose and cellulose sulfates, and saccharide derivatives such as sodium alginate and starch derivatives; and other various kinds of synthetic hydrophilic high molecular substances of mono- or copolymers such as polyvinyl alcohol, partially acetalized polyvinyl alcohol, poly-N-vinylpyrrolidone, polyacrylic acid, polymethacrylic acid, polyacrylamide, polyvinyl imidazole and polyvinyl pyrazole may be used.

Regarding the gelatin, lime-treated gelatin and acid-treated gelatin as well as enzyme-treated gelatin (as described in *Bull. Soc. Sci. Phot. Japan,* No. 16, page 30 (1966)) may be used, and in addition, a hydrolyzed product or enzyme-decomposed product of gelatin may also be used.

The photographic emulsions of the present invention may contain an inorganic or organic hardener. For instance, chromium salts (such as chromium alum, chromium acetate), aldehydes (such as formaldehyde, glyoxal, glutaraldehyde), N-methylol compounds (such as dimethylolurea, methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol), active halogen compounds (such as 2,4-dichloro-6-hydroxy-s-triazine), mucohalogenic acids (such as mucochloric acid, mucophenoxychloric acid), etc., may be used singly or in the form of a mixture thereof.

In particular, active vinyl compounds and active halogen compounds are preferably used.

The photographic emulsions to be used in the present invention may be spectrally sensitized with methine dyes or other sensitizing dyes. Usable dyes are cyanine dyes, merocyanine dyes, complex cyanine dyes, complex merocyanine dyes, holopolar cyanine dyes, hemicyanine dyes, styryl dyes and hemioxonol dyes. Especially preferred dyes are cyanine dyes, merocyanine dyes and complex merocyanine dyes. Any nucleus which is generally used in cyanine dyes as a basic heterocyclic nucleus may be adapted to these dyes. For instance, various nuclei may be adapted thereto, including a pyrroline nucleus, an oxazoline nucleus, a thiazole nucleus, a selenazole nucleus, an imidazole nucleus, a tetrazole nucleus, a pyridine nucleus; alicyclic hydrocarbon ring-fused nuclei of these nuclei; and aromatic hydrocarbon ring-fused nuclei of these nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted on the carbon atoms.

To merocyanine dyes and complex merocyanine dyes may be adapted various ketomethylene structure-containing nuclei, including a pyrazolin-5-one nucleus, a thiohydantoin nucleus, a 2-thioxazolidine-2,4-dione nucleus, a thiazolidine-2,4-dione nucleus, a rhodanine nucleus, a thiobarbituric acid nucleus or the like 5- or 6-membered heterocyclic nucleus.

These sensitizing dyes may be used singly or in the form of a combination of two or more of them, and the combination of the sensitizing dyes is often utilized for the purpose of supersensitization.

The photographic emulsion layers in the photographic materials of the present invention may contain, for the purpose of intensification of sensitivity, intensification of contrast and acceleration of development, various substances such as polyalkylene oxide or ether, ester or amine derivatives thereof, thioether compounds, thiomorpholines, quaternary ammonium salt compounds, urethane derivatives, urea derivatives, imidazole derivatives and 3-pyrazolidones.

The photographic materials of the present invention may further contain in the photographic emulsion layers or in any other hydrophilic colloid layers, a water-insoluble or sparingly water-soluble synthetic polymer dispersion, for the purpose of improvement of the dimension stability of the materials. For instance, various kinds of homopolymers or copolymers may be used, which are made of monomers selected from alkyl (meth)acrylates, alkoxyalkyl (meth)acrylates, glycidyl (meth)acrylates, (meth)acrylamides, vinyl esters (such as vinyl acetate), acrylonitriles, olefins and/or styrenes, or made of a combination of these monomers and other monomers selected from acrylic acids, methacrylic acids, $\alpha,\beta$-unsaturated dicarboxylic acids, hydroxyalkyl (meth)acrylates, sulfoalkyl (meth)acrylates and styrenesulfonic acids.

The photographic materials of the present invention may contain a color image-forming coupler or a compound capable of coloring by oxidation-coupling with an aromatic primary amine developing agent (such as phenylenediamine derivatives or aminophenol derivatives) in the color development treatment. Nondiffusible couplers having a hydrophobic group (a so-called ballast group) in the molecule or polymerized couplers are preferred. The couplers may either be tetravalent or divalent to the silver ion. In addition, the materials may further contain colored couplers having color correction effect or such couplers that may release a development inhibitor with the advance of the development (that is, so-called DIR couplers). Further, noncoloring DIR coupling compounds may be used which form a colorless product by a coupling reaction and release a development inhibitor.

Examples of magenta couplers which may be used in the present invention are 5-pyrazolone couplers, pyrazolobenzimidazole couplers, cyanoacetylcoumarone couplers and open chain acylacetonitrile couplers; examples of yellow couplers are acylacetamide couplers (such as benzoylacetanilides, pivaloylacetanilides); and examples of cyan couplers are naphthol couplers and phenol couplers.

Other constitutional elements of the silver halide photographic emulsions of the present invention and other constitutional elements of the photographic materials which may be obtained by the use of the present photographic emulsions, than those as described in the above, are not specifically limitative, and the disclosure as given in, for example, *Research Disclosure,* Vol. 176, pp. 22–30 (December, 1978) may be referred to.

According to the present invention, a large amount of iridium, which has heretofore been considered unusable, is used in the formation of silver halide grains and the resulting emulsion is subjected to sulfur sensitization or sulfur/gold sensitization, whereby a negative type emulsion of high sensitivity and noticeably reduce reciprocity law failure may surprisingly be obtained, and the effect of the present invention is quite unexpected.

The present invention will be explained in greater detail by reference to the following examples, which, however, are not intended to be interpreted as limiting the scope of the present invention.

Unless otherwise specified, all ratios, percents, etc., are by weight.

EXAMPLE 1

The following solutions (A), (B), (C) and (D) were prepared. Using these solutions, one emulsion of the present invention and five other comparative emulsions were formed in accordance with the following procedure, each having an iodine content of 2 mol % and comprising monodispersed cubic grains having an average grain size of 0.36 μm.

| | |
|---|---|
| Solution (A): | |
| Gelatin | 22 g |
| KBr | 0.84 g |
| $H_2O$ | 950 ml |
| 3,6-Dithia-1,8-octanediol | 0.15 g |
| Solution (B): | |
| $AgNO_3$ | 150 g |
| $H_2O$ | 450 ml |
| Solution (C): | |
| KBr | 123.5 g |
| KI | 3.52 g |
| $H_2O$ | 681 ml |
| Solution (D): | |
| (I) Solution comprising $K_3IrCl_6$ (1.0 wt %) and KCl (0.5 wt %) | |
| (II) Solution comprising $K_3IrCl_6$ (0.01 wt %) and KCl (0.5 wt %) | |
| (III) Solution comprising $K_3IrCl_6$ (0.001 wt %) and KCl (0.5 wt %) | |
| (IV) Solution comprising KCl (0.5 wt %) | |

Solutions ($D_1$) through ($D_6$) comprised the components (I) to (IV) as given in the following Table 1.

TABLE 1

| | ($D_1$) (ml) | ($D_2$) (ml) | ($D_3$) (ml) | ($D_4$) (ml) | ($D_5$) (ml) | ($D_6$) (ml) |
|---|---|---|---|---|---|---|
| (I) | | | | | 5.5 | 55.0 |
| (II) | | | 5.5 | 55 | | |
| (III) | | 5.5 | | | | |
| (IV) | 55.0 | 49.5 | 49.5 | | 49.5 | |

The solutions (B) and (C) were added to the solution (A), while stirred at 75° C., in the course of 60 minutes by means of a controlled double jet method, to form grains.

After 30 minutes in the formation of the grains, the solution ($D_1$) was added to obtain an emulsion ($E_{m-1}$), the solution ($D_2$) was added to obtain an emulsion ($E_{m-2}$), and analogously, other emulsions ($E_{m-3}$), ($E_{m-4}$), ($E_{m-5}$) and ($E_{m-6}$) were prepared. During the step of the formation of the grains, the pAg value in the reaction system was kept at about 7.1. Thus, six kinds of emulsions were obtained, to which Ir was added in the formation of the grains, in an amount of 0, about $10^{-7}$, about $10^{-6}$, about $10^{-5}$, about $10^{-4}$ and about $10^{-3}$ mol, per 1 mol of silver halide, respectively.

These emulsions ($E_{m-1}$) through ($E_{m-6}$) were subjected to optimum chemical sensitization, while a pertinent amount of $Na_2S_2O_3.5H_2O$ was added at the beginning of the second ripening. The ripening temperature was 65° C. and the period of the ripening was 90 minutes.

To each of these emulsions were added a gelatin hardener of 2,4-dichloro-6-hydroxy-s-triazine sodium salt and a coating aid of sodium dodecylbenzenesulfonate, each in a pertinent amount.

On the other hand, a coating solution for a protective layer was prepared, which was a 10% gelatin aqueous solution containing the same coating aid as above.

The above-prepared emulsion coating solution and protective layer coating solution were coated on a triacetate film and dried, the coated silver amount being 2.6 g/m² and the protective layer gelatin being 1.0 g/m².

These samples thus obtained were subjected to sensitometry as follows:

Each sample was exposed to light with a light source of a color temperature of 4,800° K., through an optical wedge, for 10 seconds and $10^{-3}$ second. The exposed sample was developed with a surface developer as given below for 10 minutes at 20° C., and then subjected to stopping, fixation, water washing and drying.

| Developer: | |
|---|---|
| Metol | 5.5 g |
| L-Ascorbic Acid | 22 g |
| Nabox (made by Fuji Photo Film Co., Ltd.) | 77 g |
| KBr | 2.2 g |
| $H_2O$ | up to 2.2 liters |

The sensitivity of each of these emulsions ($E_{m-1}$) through ($E_{m-6}$) in the optimum sulfur sensitization point is given in the following Table 2. For the presentation of the sensitivity of the emulsions, the sensitivity of the emulsion ($E_{m-1}$) with optimum sulfur sensitization, as exposed for $10^{-3}$ second, was represented by "100", and the sensitivity of the other emulsions was represented by the corresponding relative sensitivity thereto.

The relative sensitivity is based upon the reciprocal of the exposure amount required for providing a density of fog density +0.20.

TABLE 2

| Sample | No. | Ir (mol)/AgX (mol) | Sensitivity (10 sec) | Sensitivity ($10^{-3}$ sec) | Solarization (10 sec) | Solarization ($10^{-3}$ sec) |
|---|---|---|---|---|---|---|
| Comparative Samples | | | | | | |
| ($E_{m-1}$) | 1 | 0 | 87 | 100 | | |
| ($E_{m-2}$) | 2 | $10^{-7}$ | 57 | 60 | | |
| ($E_{m-3}$) | 3 | $10^{-6}$ | 97 | 60 | | |
| ($E_{m-4}$) | 4 | $10^{-5}$ | 100 | 89 | Noted | |
| ($E_{m-5}$) | 5 | $10^{-4}$ | 27 | 40 | Noted | Noted |
| Present Sample | | | | | | |
| ($E_{m-6}$) | 6 | $10^{-3}$ | 550 | 537 | | |

Table 2 proves the following facts: When the amount of the iridium added was $10^{-4}$ mol, extreme desensitization occurred, and when the amount thereof was within the range of $10^{-4}$ to $10^{-5}$ mol, solarization occurred and the density noticeably decreased. Whereas, when the amount of the iridium added was $10^{-3}$ mol, the sensitivity rapidly increased and no solarization was admitted, and in addition, the sensitivity was high under the two exposure conditions of $10^1$ sec and $10^{-3}$ sec. These facts are surprising and unexpected.

From the above results, it is apparent that the present invention is extremely effective.

These effects of the present invention are quite unexpected and are extremely surprising.

EXAMPLE 2

In the same manner as in Example 1, the emulsions ($E_{m-1}$) and ($E_{m-6}$) were prepared and these were subjected to gold/sulfur sensitization. The surface sensitivity of each sample is shown in the following Table 3. The exposure time was $10^{-4}$ second and 1 second.

The sensitivity of the emulsion ($E_{m-1}$) with sulfur sensitization, as exposed for $10^{-3}$ second was considered 100, and the sensitivity of other cases was represented by the corresponding relative sensitivity thereto.

The amount of the gold sensitizer ($KAuCl_44H_2O$) and that of the sulfur sensitizer ($Na_2S_2O_3$. $5H_2O$) as used herein were made to be optimum under the exposure condition of 1 second in each sample.

TABLE 3

| | Sample No. | | | |
|---|---|---|---|---|
| | 7 | 8 | 9 | 10 (present sample) |
| Emulsion | ($E_{m-1}$) | ($E_{m-1}$) | ($E_{m-6}$) | ($E_{m-6}$) |
| Chemical Sensitizer | Not used | Used | Not used | Used |
| Sensitivity (1 sec) | 35.0 | 708 | No image formed | 1,260 |
| Sensitivity ($10^{-4}$ sec) | 97 | 396 | No image formed | 1,390 |

As is apparent from the above Table 3, Sample No. 10 (of the present invention) which contained iridium in an amount of $10^{-3}$ mol/mol AgX and which was subjected to sulfur/gold sensitization was extremely highly sensitive when exposed for 1 second and $10_{-4}$ second, and no reciprocity law failure was admitted.

This result is extremely unexpected and surprising.

EXAMPLE 3

In the same manner as in Example 1, with the exception that a solution (C') comprising KBr (126 g) and $H_2O$ (681 ml) and additionally containing about 65 ml of the solution (I) was used instead of the solution (C), an emulsion ($E_{m-7}$) was formed. In the preparation of this emulsion ($E_{m-7}$), the solution in Example (D) was not added, and the others were the same as those in Example 1. Thus, the amount of the iridium added during the formation of the grains was $10^{-3}$ mol/mol AgX, and the iridium was almost uniformly and continously added to the reaction system during the formation of the grains.

The emulsion ($E_{m-7}$), thus formed as well as the other previously formed emulsions ($E_{m-1}$) and ($E_{-6}$) were subjected to optimum sulfur sensitization and then exposed for 1 second to form Sample Nos. 11, 12 and 13, respectively. The sensitivity of each sample was given in the following Table 4, where the sensitivity of Sample No. 12 was represented by 100 and that of the other samples was represented by the corresponding relative sensitivity thereto.

TABLE 4

| | Sample No. | | |
|---|---|---|---|
| | Comparative Sample | Present Sample | |
| | 12 | 13 | 14 |
| Emulsion | ($E_{m-1}$) | ($E_{m-6}$) | ($E_{m-7}$) |
| Sensitivity | 100 | 501 | 200 |

The above Table 4 proves the fact that the emulsion ($E_{m-6}$) which was formed by adding the total amount of the iridium after the grains had grown to about 80% or more of the average grain size thereof is more effective than the other emulsion ($E_{m-7}$).

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic emulsion formed by growing silver halide grains in the presence of a water-soluble iridium salt in a molar ratio of $3\times10^{-4}$ mol or more to the amount of the total silver halides used in the formation of the silver halide grains and then chemically sensitizing the surfaces of the grains formed with a sulfur compound or with a sulfur compound and a gold compound.

2. The negative type silver halide photographic emulsion as claimed in claim 1, wherein the molar ratio of the water-soluble iridium salt to be incorporated is $5\times10^{-4}$ mol to $3\times10^{-3}$ mol to the amount of the total silver halides used in the formation of the silver halide grains.

3. The negative type silver halide photographic emulsion as claimed in claim 1, wherein the total amount of the water-soluble iridium salt is added all at once at any stage during the formation of the silver halide grains.

4. The negative type silver halide photographic emulsion as claimed in claim 1, wherein the water-soluble iridium salt is added at intervals in several separate amounts.

5. The negative type silver halide photographic emulsion as claimed in claim 1, wherein the water-soluble iridium salt is gradually added continuously.

6. The negative type silver halide photographic emulsion as claimed in claim 4, wherein 80% or more of the total amount of the water-soluble iridium salt to be added is added after the silver halide grains have grown to 70% or more of the average grain size thereof.

7. The negative type silver halide photographic emulsion as claimed in claim 1, wherein the water-soluble iridium salt is selected from $K_3IrCl_6$, $K_2IrCl_6$, $(NH_4)_2IrCl_6$ and $Na_2IrCl_6$.

8. The negative type silver halide photographic emulsion as claimed in claim 1, wherein an iridium compound stabilizer of a hydrogen halide aqueous solution or an alkali halide is added together with the iridium compound.

* * * * *